United States Patent [19]

Shaw

[11] Patent Number: 5,060,580

[45] Date of Patent: Oct. 29, 1991

[54] FOOD MANAGEMENT TABLE

[76] Inventor: William L. Shaw, 1224 Randolph, Detroit, Mich. 48226

[21] Appl. No.: 505,843

[22] Filed: Apr. 6, 1990

[51] Int. Cl.[5] ..... A47B 85/00

[52] U.S. Cl. ..... 108/25; 312/140.2; 108/33

[58] Field of Search ..... 108/25, 26, 50, 161, 108/24, 33, 34; 99/645, 646 C; 312/140.1, 140.3, 140.4

[56] References Cited

U.S. PATENT DOCUMENTS

| | | | |
|---|---|---|---|
| 2,897,973 | 8/1959 | Sizemore | 108/24 |
| 3,068,852 | 12/1962 | Purtzer | 108/33 |
| 3,394,666 | 7/1968 | Pearlman | 108/44 |
| 4,883,001 | 11/1989 | Roth . | |

OTHER PUBLICATIONS

J. C. Penney Catalog of 1986, p. 613.
National Business Supply, Inc., Catalog of 1988, p. 121.

*Primary Examiner*—Kenneth J. Dorner
*Assistant Examiner*—Gerald A. Anderson
*Attorney, Agent, or Firm*—Peter D. Keefe

[57] ABSTRACT

A table is structured to hold food stuffs safe from insect and other small animal intrusion, while simultaneously providing for easy access to the food stuffs, while also providing a surface that can be used as a place setting for eating of the food stuffs. The invention is composed of a table member that includes an internal storage area for holding articles therein, at least one movably mounted screened cover for enclosing the internal storage area, and a plurality of legs for holding the table member at a preselected height. The invention further includes means for adjusting the length of the legs, a planar cover for the table for covering at least a portion of the internal storage area and thereby provide an eating surface, leg detachment means for permitting the legs to be selectively detached from the table member in order to facilitate portability of the table, and table member fold means for permitting the table member to be foldable into a compact unit that may be readily carried in a standard automobile trunk.

9 Claims, 2 Drawing Sheets

FOOD MANAGEMENT TABLE

BACKGROUND OF THE INVENTION

1. Field of the Invention

The present inventin relates to food serving tables, and more particularly to a table that provides for general food management, in that it holds food, provides protection of the food from insects and facilitates serving of the food.

2. Description of the Prior Art

It is a very frequent experience to be out-of-doors commencing to enjoy a picnic or barbecue, only to shortly thereafter have flies, bees, ants or other annoying insects spoil the fun. Ordinarily, common picnic tables are used for the distribution and eating of food. While picnic tables serve their utilitarian role nicely, they offer essentially no protection for the food against insect intrusion. Alternatively, some picnicers utilize a picnic basket or an ice chest to contain their food. While these devices offer insect protection, they are frequently bulky, heavy and do not serve as a table for dispensing and eating of the food.

Consequently, what is needed in the art is a device which can protect food against insect contamination, while at the same time providing a table for providing easy food distribution and an eating surface.

SUMMARY OF THE INVENTION

The present invention is a table which is structured to hold food stuffs safe from insect and other small animal intrusion, while simultaneously providing for easy access to the food stuffs. Further, the table according to the present invention provides for a surface that can be used as a place setting for eating of the food stuffs.

The present invention is composed of a table having a table member including an internal storage area for holding articles within the table member; at least one movably mounted screened cover for enclosing the internal storage area; and a plurality of legs for holding the table member at a preselected height.

The present invention further includes means for adjusting the length of the legs, a planar cover for the table for covering at least a portion of the internal storage area and thereby provide an eating surface, leg detachment means for permitting the legs to be selectively detached from the table member in order to facilitate portability of the table, and table member fold means for permitting the table member to be foldable into a compact unit that may be readily carried in a standard automobile trunk.

Accordingly, it is an object of the present invention to provide a table which has an internal storage area for holding articles such as food stuffs secure from insects and other small animals.

It is a further object of the present invention to provide a table which has a internal storage area for holding articles such as food stuffs secure from insects and other small animals, the insects and other small animals being excluded by operation of at least one movably mounted screen cover.

It is still a further object of the present invention to provide a table which has an internal storage area for holding articles such as food stuffs secure from insects and other small animals, the insects and other small animals being exluded by operation of at least one movably mounted screen cover, the table having legs which are adjustable in length so as to best facilitate the operations of food dispensing or food eating.

It is yet a further object of the present invention to provide a table which has an internal storage area for holding articles such as food stuffs secure from insects and other small animals, the insects and other small animals being exluded by opertion of at leas one movably mounted screen cover, the table having selectably removable legs for facilitating portability.

It is still another object of the present invention to provide a table which has an internal storage area for holding articles such as food stuffs secure from insects and other small animals, the insects and other small animals being excluded by operation of at least one movably mounted screen cover the table being foldable so as to maximize portability.

These, and additional objects, advantages, features and benefits of the present invention will become apparent from the following specification.

BRIEF DESCRIPTION OF THE DRAWINGS

FIG. 8 is seen along lines 8—8 in FIG. 6, and FIG. 9 is seen along lines 9—9 in FIG. 6.

DETAILED DESCRIPTION OF THE PREFERRED EMBODIMENTS

Figure 1:
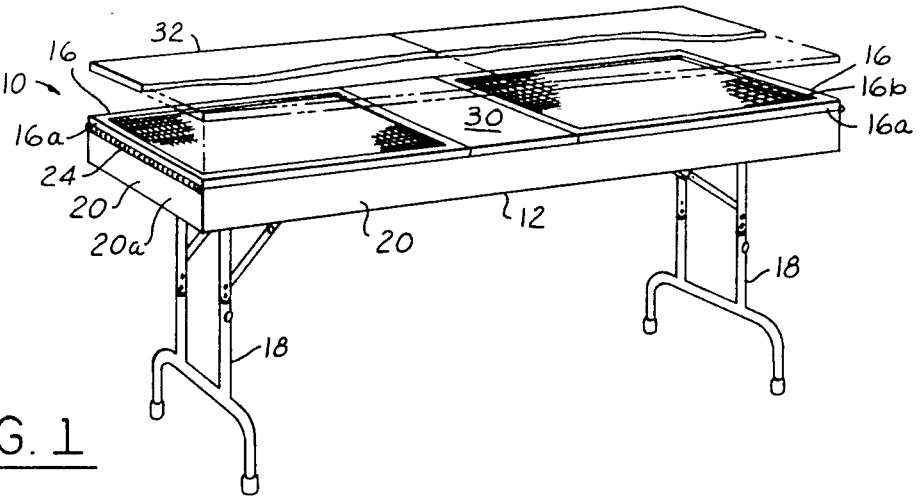
FIG. 1 is a perspective view of the table according to the present invention.
Figure 2:
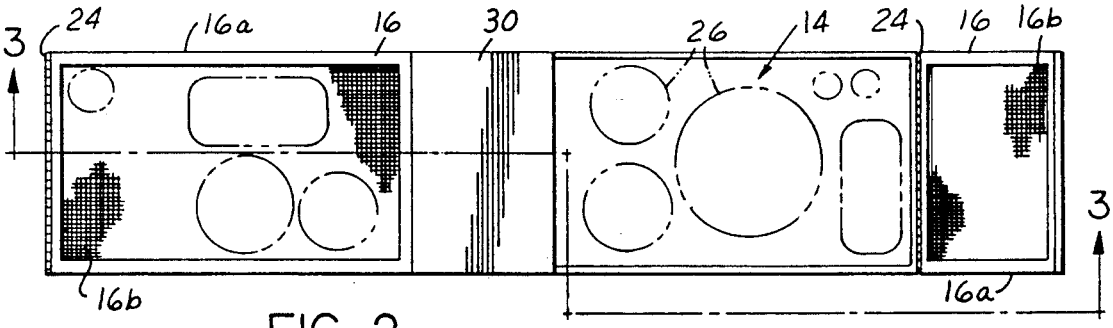
FIG. 2 is a plan view of the table according to the present invention.
Figure 3:
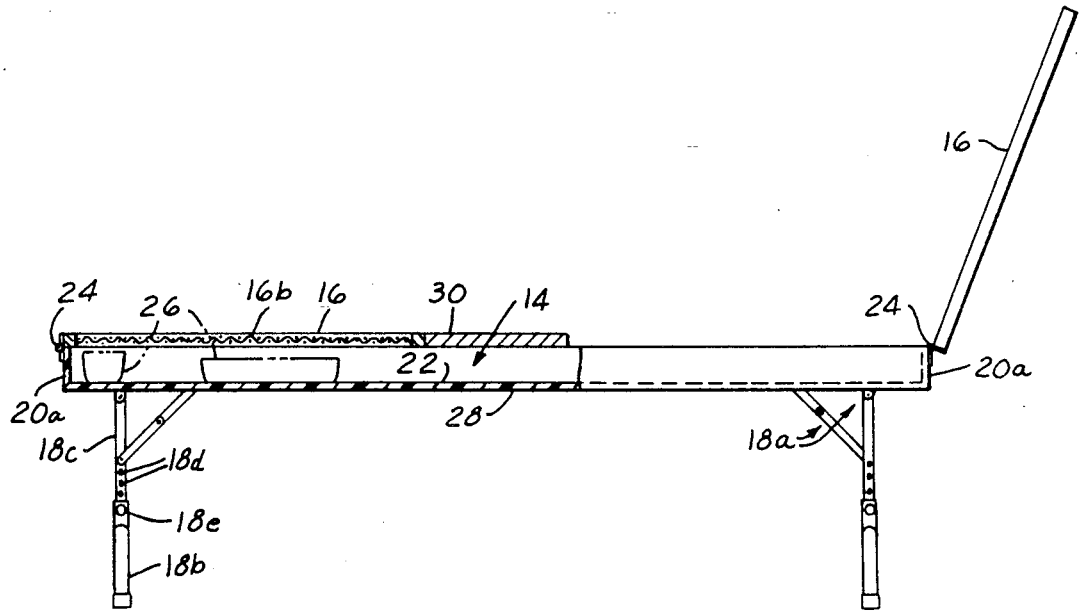
FIG. 3 is a side view of the table, seen along lines 3—3 in FIG. 2.

Referring now to the drawing, FIGS. 1 through 3 show a first preferred configuration for food management table 10 according to the present invention. The food management table is composed generally of a table member 12, an internal storage area 14 within the table member 12, at least one cover member 16 movably connected to the table member, and a plurality of legs 18 connected to the table member.

The table member 12 is preferred to be dimensioned in the shape of a rectangle on the order to two feet wide by six feet long and one-half foot deep. A preferred construction material is selected from wood, plastic or non-corrosive metal. The table member includes an internal storage area 14 defined by sidewalls 20 and floor 22, each of which having a preferred thickness on the order of one inch.

Situated above the internal storage area 14, at least one cover member 16 is movably connected to an endwall **20*a* of the sidewalls 20 via a hinge 24. It is preferred that each cover member 16 (two being showing in the Drawing) be constructed of a rigid frame 16***a* spanned by a screen material 16*b*. The aforesaid screen type of covering is preferred because it allows therethrough for heat exchange and easy viewing with respect to the contents 26 of the internal storage area 14, yet will fit with respect to the sidewalls so as to exclude entry of insects or other small animals into the internal storage area. The contents 26 can include any articles, such as picnic supplies, food stuffs and ice. In the event it is desired to keep foods cold via ice, it is possible to to provide a table member having insulatory properties, and further possible to provide cover members having insulatory properties (that is, rather than providing cover members spanned with screen material as described hereinabove, the cover members are constructed using an insulatory planar material).

The legs 18 are preferred to be connected to the bottom 28 of the floor 22 by a pivot connection system 18*a* so that they may be folded up against the floor in a manner generally known in the table art. Further, the legs are preferred to be adjustable in length through operation of a telescopic interconnection between a lower leg segment 18*b* and an upper leg segment 18*c*, in which a plurality of holes 18*d* and a pin 18*e* serve to provide selection of the leg length in a generally conventional manner known in the table art.

It is further preferred to provide a central table top 30 for placing contents 26 thereonto, as may from time to time be needed.

Further, as indicated by FIG. 1, it is preferred to include a rigid planar sheet 32 which may be placed upon the table, over the cover members 16 and central table top 30. When the contents 26 need not be further accessed, the planar sheet 32 serves to provide a flat table top for the food management table 10 in a generally conventional table-like manner. With the planar sheet 32 in place, the food management table 10 now serves as a convenient table with which to eat.

In operation, the user grips a cover member 16 and pivots it upwardly so as to uncover the internal storage area 14. Thereupon various contents 26, such as food stuffs, paper plates, or other items, are placed in the internal storage area. When access to the contents 26 is needed, it is a very simple matter for the user to spot what he or she desires, then lift to appropriate cover member so as to access the desired item. The desired item may thereupon be placed, if desired, on the central table top 30. When accessing of contents is completed, the planar sheet 32 may be placed over the cover members, so as to provide a table-like surface for eating and the like. The length of the legs 18 is adjusted to accommodate whether the primary function of the food management table 10 is going to be contents distribution or table surface utilization, the former being better served by a greater leg length than that for the latter.

Figure 4:
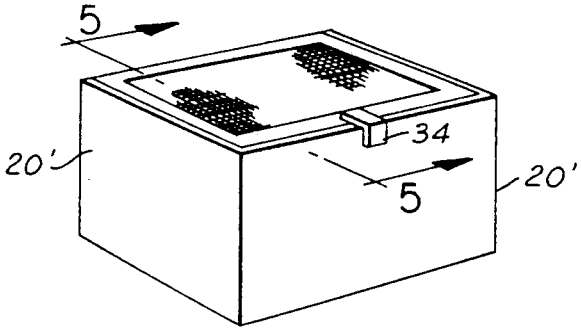
FIG. 4 is a perspective view of an alternative embodiment of the present invention.
Figure 5:
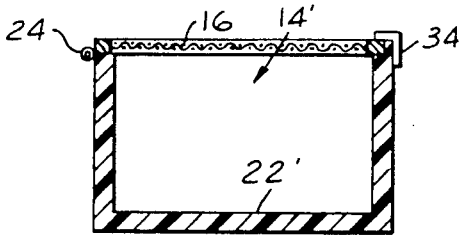
FIG. 5 is a sectional side view of the alternative embodiment of the present invention, seen along lines 5—5 in FIG. 4.
Figure 6:
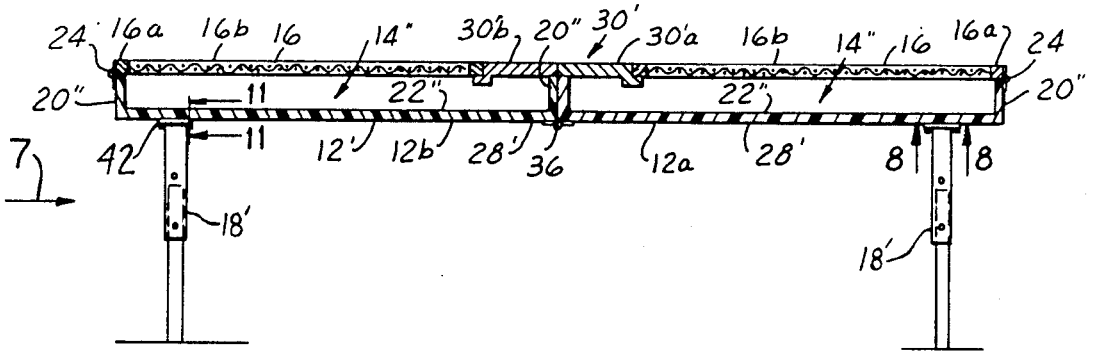
FIG. 6 is a side view of an alternative embodiment of the table, seen generally from the same vantage point as that of FIG. 2.
Figure 7:
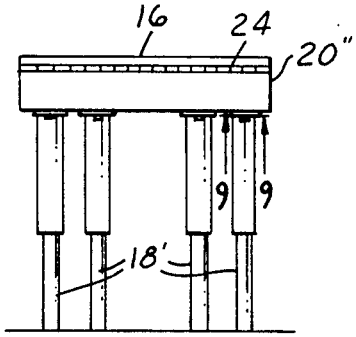
FIG. 7 is an end view of the alternative embodiment of the table, seen along arrow 7 in FIG. 6.

FIGS. 4 and 5 show a variation in the present invention in which the food management table is legless. The internal storage area 14' is defined by sidewalls 20' and floor 22'. A latch 34 is provided to secure the cover member 16 to the sidewalls (there may be more than one cover member). Further, the legless table shown in FIGS. 4 and 5 may be sized so as to reside in the internal storage area 14 of the table member 12 hereinabove described.

Figure 8:
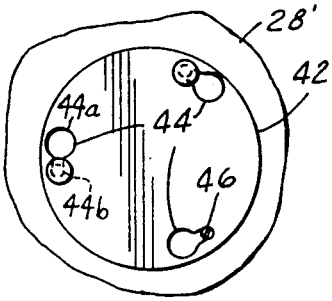
FIGS. 8 and 9 show connection details of the legs of the alternative embodiment of the table shown in FIG. 6, where
Figure 9:
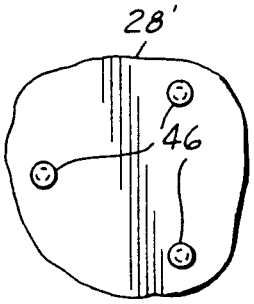
Figure 10:
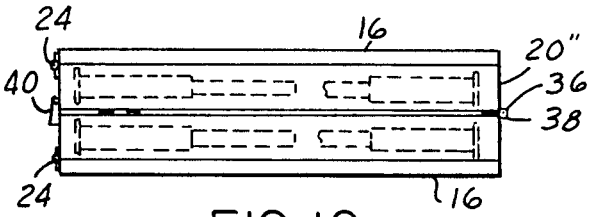
FIG. 10 is a side view of the alternative embodiment of the table of FIG. 6, shown in a folded configuration.

FIGS. 6 through 11 detail an alternative structure for the food management table 10. In this particular structure, the table member 12' is segmented into two equally dimensioned table member segments 12*a* and 12*b*. Each table member segment has its own sidewalls 20'' and floor 22'' so as to form its own internal storage area 14''. The two table member segments are conjoined to form the table member 12' via a hinge 36. The central table top 30' is divided also into two equal parts 30'*a* and 30'*b*, each part being respectively associated with a table member segment. With this structure, the table member 12' may be pivoted at hinge 36 so that one table member segment 12*a* may be folded against the other table member segment 12*b*. When folded as shown in FIG. 10, the food management table 10 is extremely compact for purposes of either storage or transportation. A conventional clasp 40 is provided on the sidewalls 20'' opposite the hinge 36 to provide releasable connection of the two table members segments when in the folded configuration of FIG. 10. Because the hinge 36 is located at the bottom 28' of floors 12*a* and 12*b*, when the food management table is in the operational configuration of FIG. 6, the sidewalls 20'' adjacent the hinge 36 will abut each other and thereby provide rigidity.

Figure 11:
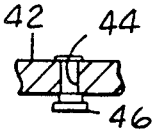
FIG. 11 is a detail side view of the leg connection attachment system, seen along lines 11—11 in FIG. 6.

FIGS. 8, 9 and 11 detail how the legs 18' may be structured to be removably attachable to the table member 12'. Again, the legs are constructed for being telescopically adjustable in the manner described hereinabove. The top of each leg is preferred to be provided with a flange 42 having spaced apart holes 44, the holes having conjoining larger and smaller diameter hole portions 44*a* and 44*b*, respectively. Bosses 46 are provided in the bottom 28' of the floors, and the bosses releasably interconnect in a generally conventional manner with the holes 44 as the flange 42 is rotated relative thereto so that the bosses seat in the smaller diameter hole portions 44*b* of the holes.

In operation, the user would access contents 26 from the internal storage areas 14'' in the manner hereinabove described, and the planar sheet 32 can be utilized also in the manner hereinabove described. Upon the completion of use, the legs 18' are removed by rotating them so as to rotate the bosses into the larger diameter portions 44*a* of the holes 44 so that they may be removed therefrom. The legs are then optionally placed in the internal storage areas. The two table member segments are now rotated on the hinge 36 until the clasp 40 interlocks them together. The food management table 10 may now be transported or stored. To use the food management table the steps are reversed.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A food management table, comprising:

a table member, said table member having a floor and sidewalls which collectively define an internal storage area for the storage of articles;

table member folding means connectged with said floor and sidewalls for enabling said table member to be selectively foldable from a first folded position for storage and transportation of said table member to a second unfolded position for table use of said table member;

at least one cover member movably connected with said sidewalls of said table member for selectively covering said internal storage area, said at least one cover member mating with said sidewalls so as to prevent intrusion into said internal storage area by insects, wherein said at least one cover member comprises:

a frame a hinge pivotally connecting said frame to said sidewalls of said table member; and a screen material spanning said frame; and a plurality of legs connected with said table member.

2. The food management table of claim 1, further comprising a rigid planar sheet for placement upon at least one of said at least one cover member and said sidewalls for serving as a table surface.

3. The food management table of claim 1, further comprising means connected with each leg of said plurality of legs for selectively adjusting the length of each said leg.

4. The food management table of claim 1, wherein said table member comprises two substantially equally dimensioned table member segments, said table member folding means conjoining said two table member segements.

5. The food management table of claim 1, wherein two said cover members are present, each pivotally connected to said table member at opposite locations on said sidewalls, said food management table further comprising a central table top connected with said sidewalls for placing articles thereupon, said central table top being located between each of said two cover members.

6. The food management table of claim 5, further comprising means connected with said table member and each said leg for permitting each said leg to be selectively foldable relative to said table member.

7. The food management table of claim 6, further comprising a rigid planar sheet for placement upon at least one of said at least one cover member and said sidewalls for serving as a table surface.

8. The food management table of claim 5, further comprising means connected with said table member and each said leg for permitting each said leg to be selectively detached from said table member.

9. The food management table of claim 8, further comprising a rigid planar sheet for placement upon at least one of said at least one cover member and said sidewalls for serving as a table surface.

* * * * *